US009062472B2

(12) United States Patent
Scali et al.

(10) Patent No.: US 9,062,472 B2
(45) Date of Patent: Jun. 23, 2015

(54) SPA RIM

(75) Inventors: Ian P. A. Scali, Ontario, CA (US); Erica A. Moir, Santa Ana, CA (US); Adrian Alfaro, Menifee, CA (US)

(73) Assignee: Sundance Spas, Inc., Chino, CA (US)

( * ) Notice: Subject to any disclaimer, the term of this patent is extended or adjusted under 35 U.S.C. 154(b) by 550 days.

(21) Appl. No.: 13/104,256

(22) Filed: May 10, 2011

(65) Prior Publication Data

US 2011/0271437 A1 Nov. 10, 2011

Related U.S. Application Data

(60) Provisional application No. 61/332,871, filed on May 10, 2010.

(51) Int. Cl.

| | |
|---|---|
| ***E04H 4/00*** | (2006.01) |
| ***A47K 3/02*** | (2006.01) |
| ***E04H 4/14*** | (2006.01) |

(52) U.S. Cl.

CPC ..... *E04H 4/141* (2013.01); *Y10T 29/49718* (2015.01)

(58) Field of Classification Search

CPC ..... A47K 3/00; A47K 3/02; E04H 4/141
USPC ..... 4/496, 506, 584, 488; 52/169.5, 245, 52/300

See application file for complete search history.

(56) References Cited

U.S. PATENT DOCUMENTS

| | | | | |
|---|---|---|---|---|
| 3,233,251 | A * | 2/1966 | Barrera | 52/245 |
| 3,793,651 | A * | 2/1974 | Pitti et al. | 52/169.7 |
| 4,271,542 | A | 6/1981 | Wood et al. | |
| 5,303,527 | A | 4/1994 | Perez et al. | |
| 5,611,173 | A * | 3/1997 | Headrick et al. | 49/468 |
| 6,718,566 | B1 | 4/2004 | Wilson | |
| 6,915,535 | B2 * | 7/2005 | Sieger et al. | 4/559 |
| 7,412,733 | B2 | 8/2008 | Dorsch | |
| 7,802,324 | B2 * | 9/2010 | Layfield et al. | 4/541.1 |
| 2003/0000166 | A1 * | 1/2003 | Arignon | 52/300 |
| 2009/0188180 | A1 * | 7/2009 | Irvine et al. | 52/169.13 |

* cited by examiner

*Primary Examiner* — Huyen Le
*Assistant Examiner* — Christine Skubinna
(74) *Attorney, Agent, or Firm* — The Webb Law Firm

(57) ABSTRACT

A rim for engaging a vessel wall of an existing liquid-containing vessel, wherein the vessel wall defines a liquid-containment area, and wherein the vessel is open ended could includes a rail cap comprising a cap surface and two spaced apart rail cap walls attached to and depending from the cap surface defining a rail cap cavity adapted to engage the vessel wall. The rim could include a plurality of rim segments and a segment seam cap for positioning over a seam formed between adjacent rim segments.

24 Claims, 19 Drawing Sheets

SPA RIM

CROSS REFERENCE TO RELATED APPLICATIONS

The present application claims priority to U.S. Provisional Patent Application No. 61/332,871, filed May 10, 2010, entitled "Spa Rim", which is hereby incorporated by reference in its entirety.

BACKGROUND OF THE INVENTION

1. Field of the Invention

The present invention relates to rims for liquid-containing vessels, such as spa tubs, and, more particularly, to rims for retrofitting walls of a liquid-containing vessel.

2. Description of Related Art

Liquid-containing vessels, such as spa tubs, pools, or bath tubs, often include vessel walls which are undesirable for one reason or another. For example, the vessel wall may include a railing, such as an acrylic railing, that is curved in an undesired fashion, the vessel railings may not be uniform around the entire perimeter of the vessel, or they may simply not be aesthetically pleasing to its users.

A need exists for a vessel rim which overcomes these deficiencies and which is capable of simple construction, and which may also be used to retrofit existing liquid-containing vessels.

SUMMARY OF THE INVENTION

One embodiment of the present invention is a rim for engaging a vessel wall of an existing liquid-containing vessel, wherein the vessel wall defines a liquid-containment area, and wherein the vessel is open ended. The rim includes a rail cap comprising a cap surface and two spaced apart rail cap walls attached to and depending from the cap surface defining a rail cap cavity adapted to engage the vessel wall. At least one of the rail cap walls could includes a vessel engagement protuberance extending inward toward the cavity, the vessel engagement protuberance adapted to engage the vessel wall. The rail cap cavity of the rail cap could include an open end, wherein the protuberance is positioned at the open end of the rail cap cavity. An adhesive layer could be positioned on the cap surface in the rail cap cavity. One wall of the rail cap walls is longer than the other rail cap wall. In one embodiment, the rail cap could include a planar surface. The rail cap could be a plurality of rim segments, the segments being oriented such that the rim segments are adjacent to each other to define a closed perimeter vessel rim. A segment seam cap having two spaced apart engagement members depending therefrom, could be positioned over two adjacent segments having a seam formed therebetween, wherein the engagement members engage the adjacent segments to fix the segments in position. The rim could also include a substructure channel having a substructure surface and two spaced apart substructure walls attached to and depending from the substructure surface, wherein the substructure walls define a substructure cavity, wherein the substructure channel is received within the rail cap cavity. The rail cap could be fixedly attached to the substructure channel. Each of the rail cap walls could include a vessel engagement protuberance and each of the substructure channel walls includes a protuberance receiving recess, each of the vessel engagement protuberances being received within the protuberance receiving recesses to engage the substructure channel in an interference fit arrangement. The substructure surface could include spacers depending therefrom between the substructure channel and the rail cap. Mechanical fasteners could extend through the substructure channel for fastening the substructure to the top surface of the spa railing. The substructure cavity of the substructure channel could include an opened end, wherein each of the substructure channel walls includes an internal edge positioned at the open end of the substructure channel. In one embodiment, a moisture barrier could be provided and positioned on one of the rail cap walls in the rail cap cavity. In one embodiment the rim includes a substructure channel having a substructure surface and two spaced apart substructure walls attached to and depending from the substructure surface, wherein the substructure walls define a substructure cavity, wherein the substructure channel is received within the rail cap cavity; wherein the rail cap includes a planar surface; wherein each of the rail cap walls includes a vessel engagement protuberance and each of the substructure channel walls includes a protuberance receiving recess, each of the vessel engagement protuberances being received within the protuberance receiving recesses, such that the rail cap and the substructure channel are engaged in an interference fit; and wherein the substructure cavity of the substructure channel includes an opened end, wherein each of the substructure channel walls includes an internal edge positioned at the open end of the substructure channel.

In another embodiment of the presenting a liquid-containing vessel could include a wall having an open end and a closed end defining a liquid-containment area and a rim positioned on the opened end of the wall. The rim could include a rail cap comprising a cap surface and two spaced apart rail cap walls attached to and depending from the cap surface defining a rail cap cavity, wherein the open end of the wall is received within the rail cap cavity. The open end of the vessel wall could be a railing. At least one of the rail cap walls could include a vessel engagement protuberance extending inward toward the rail cap cavity. The vessel engagement protuberance engages the railing. The rail cap and the vessel wall could be engaged in an interference fit. The vessel rim could include a plurality of adjacent rim segments defining a closed-perimeter rim. The vessel could also include a segment seam cap having two spaced apart engagement members depending therefrom, wherein the seam cap is positioned over two adjacent segments having a seam formed therebetween, wherein the engagement members engage the adjacent segments to fix the segments in position. In one embodiment, the vessel could be a spa.

Another embodiment of the present invention is directed to a method of retrofitting an existing liquid-containment vessel with a rim, wherein the vessel comprises a vessel wall having an open end and closed end defining a liquid-containment area. The method includes positioning a rail cap having a cap surface and two side walls attached to and depending from the cap surface defining a rail cap cavity on the open end of the vessel wall, such that the vessel wall is received within the rail cap cavity. Positioning a rail cap on the open end of the vessel wall could include positioning a plurality of adjacent rim segments to define a closed perimeter rim, and further comprising the step of positioning a segment seam cap over as seam defined between two adjacent segments of the plurality of segments.

BRIEF DESCRIPTION OF THE DRAWINGS

A more complete understanding of the spa rim can be obtained by considering the following description in conjunction with the accompanying drawing figures in which.

DESCRIPTION OF THE PREFERRED EMBODIMENTS

Figure 1:
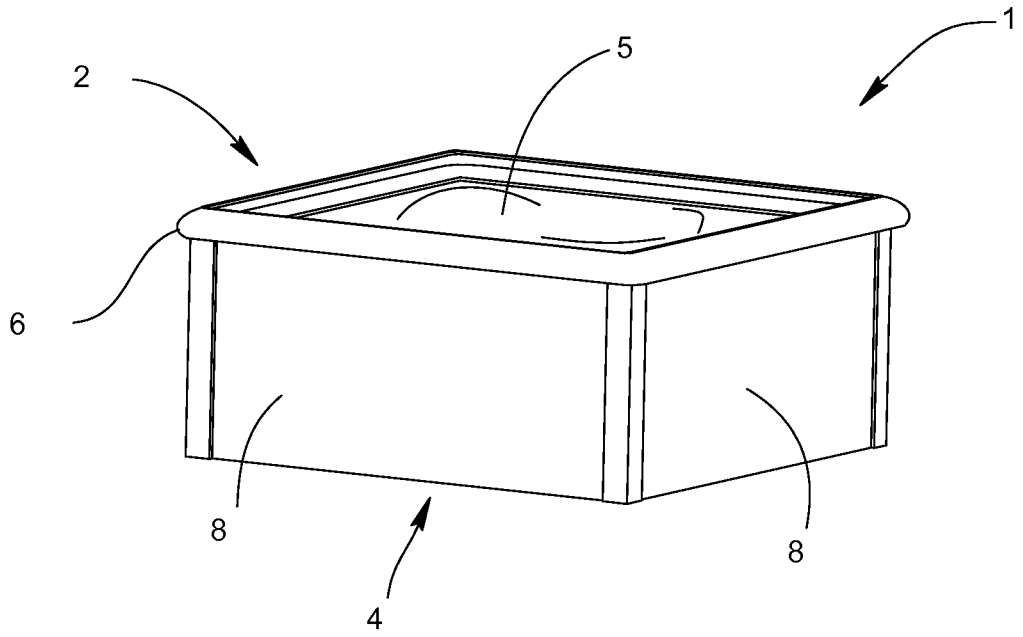
FIG. 1 PRIOR ART
FIG. 1 is an embodiment of a liquid-containing vessel according to the prior art.

For purposes of the description hereinafter, the words "upper", "lower", "right", "left", "top", "bottom", "vertical", "horizontal", "inward", "outward", "lateral", "longitudinal" and like spatial terms, if used, shall related to the described embodiments as oriented in the drawings figures. However, it is to be understood that many alternative variations and embodiments may be assumed excepted where expressly specified to the contrary. It is also to be understood that the specific devices and embodiments illustrated in the accompanying drawings and described herein are simply exemplary embodiments of the invention.

Referring now to the figures in which like reference numbers refer to like elements, FIG. 1 shows a liquid-containing vessel 1 according to the prior art, such as a spa, bath tub, swimming pool, or other closed perimeter vessel adapted to contain liquid. The liquid-containing vessel 1 is open ended including a vessel wall 8 having an open end 2 and a closed end 4 defining a liquid-containment area 5. The vessel wall 8 may include a railing 6. For example, the railing 6 could be an acrylic railing of a spa tub.

Figure 2:
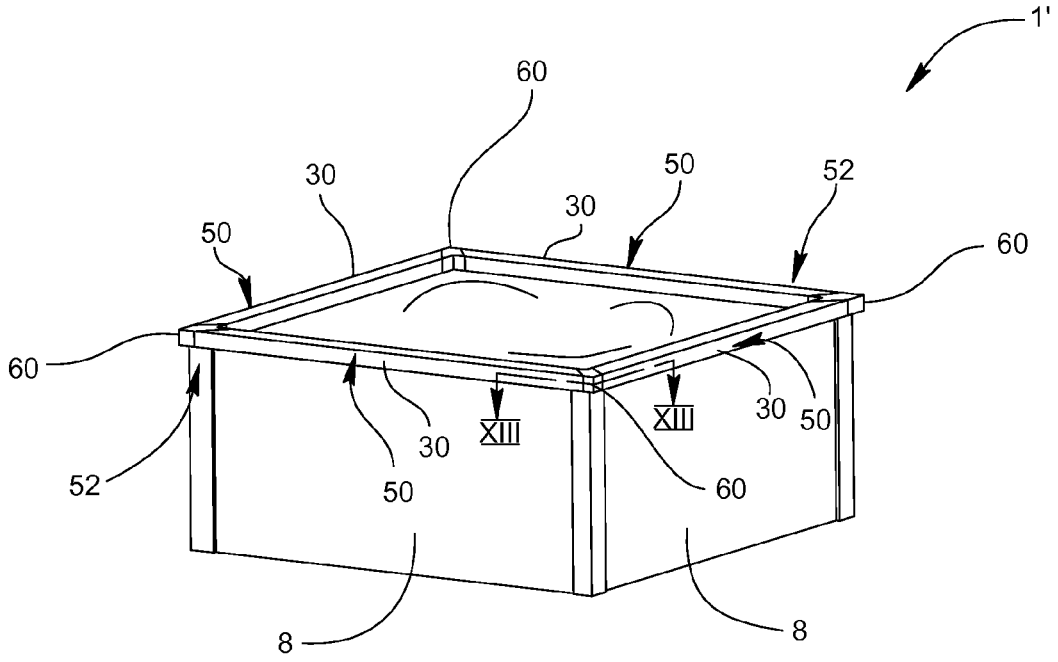
FIG. 2 is a perspective view of a liquid-containing vessel according to the present invention.
Figure 3:
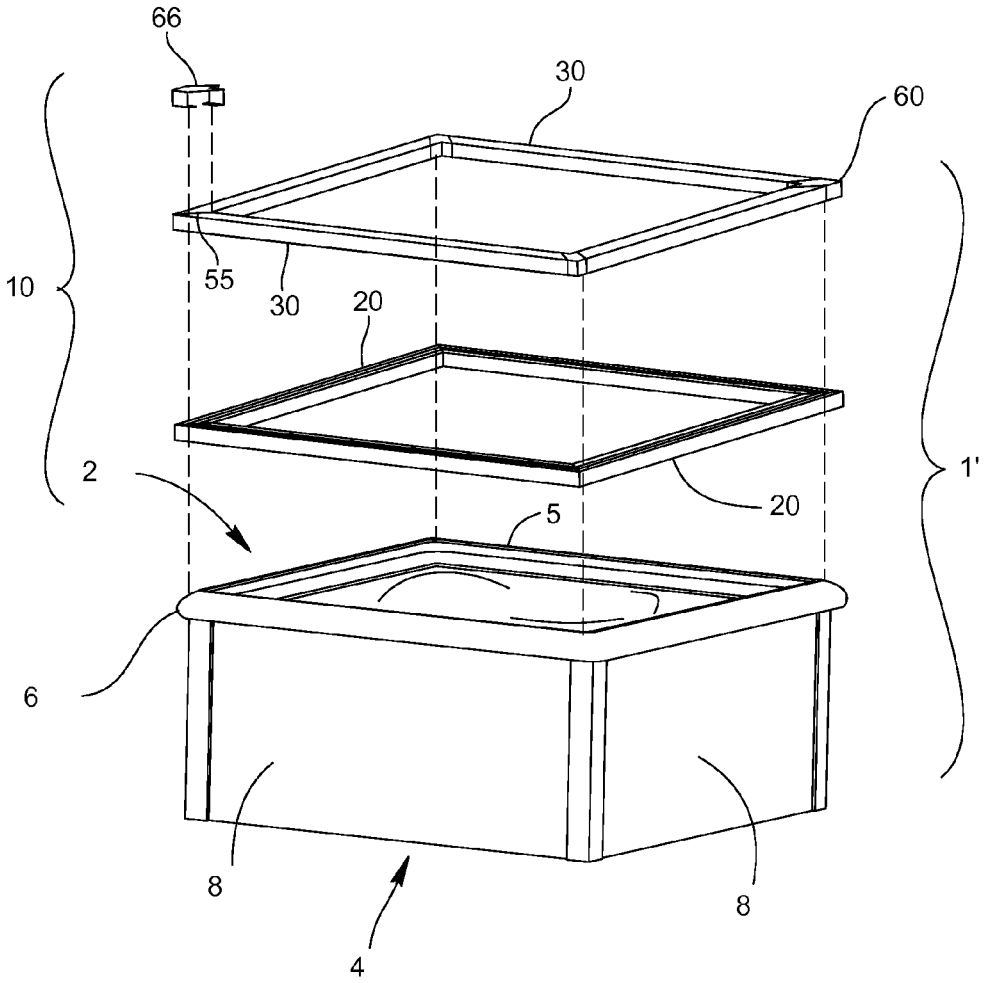
FIG. 3 is an exploded view of one embodiment of the liquid-containing vessel of FIG. 2.
Figure 4:
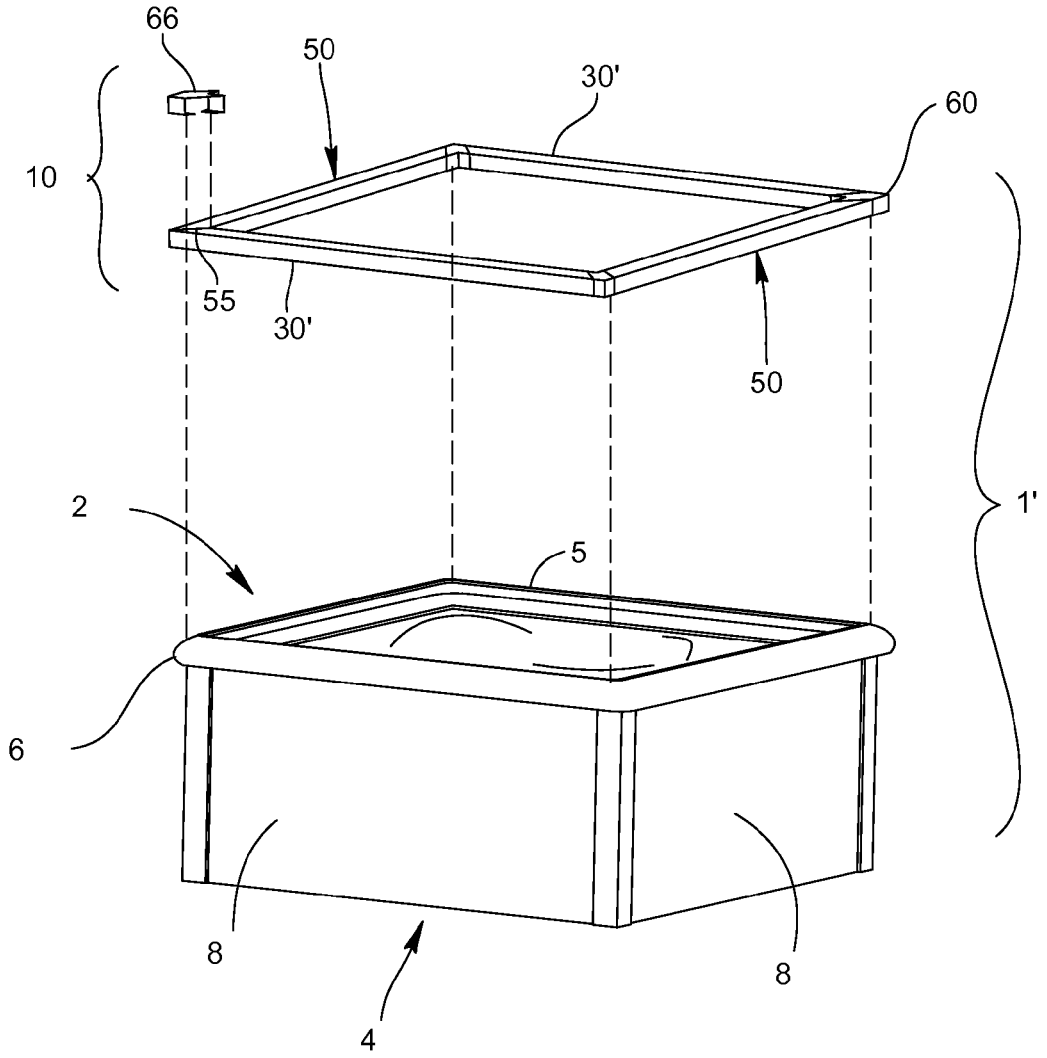
FIG. 4 is another embodiment of a liquid-containing vessel according to the present invention similar to FIG. 3 without a substructure channel.
Figure 5:
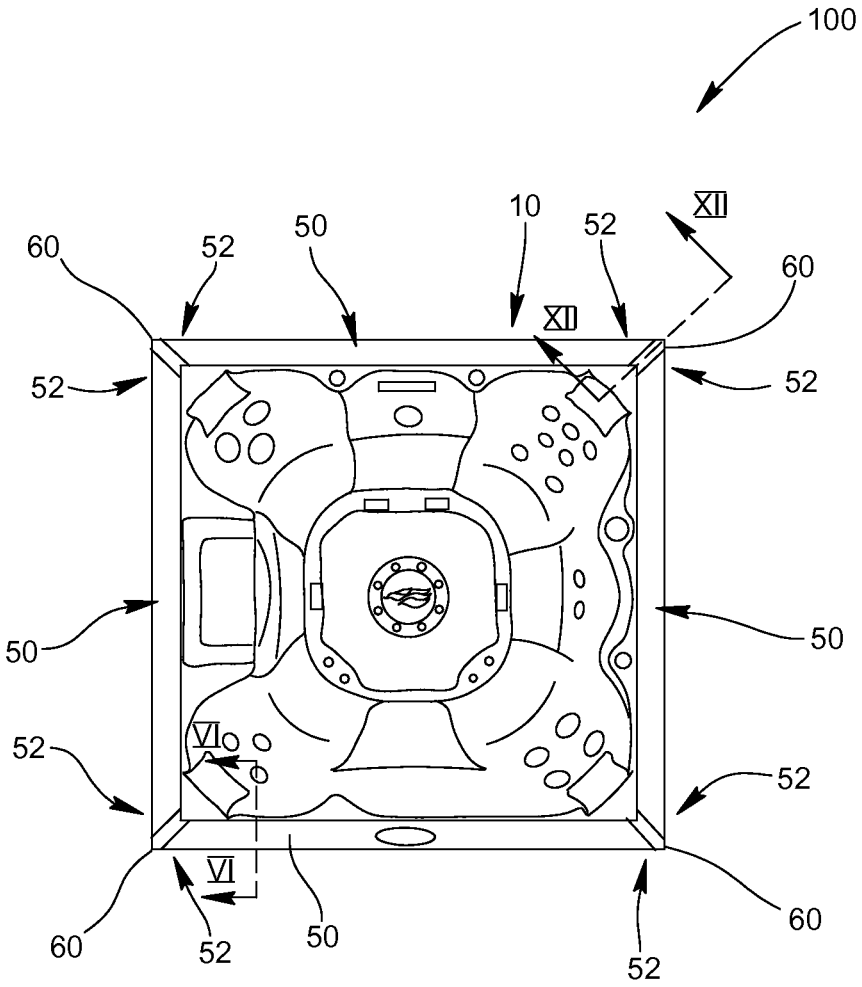
FIG. 5 is a top view of the liquid-containing vessel of FIG. 2.

Referring now to FIGS. 2-5, embodiments of a liquid-containing vessel 1' is shown with a rim 10 according to the present invention. In FIG. 5, which is a top view of the liquid-containing vessel 1', the liquid containment area 5 could, for example, be the inner shell of a spa. Referring specifically to FIG. 3-4, the rim 10 could include a top cap rail 30 or 30'. Generally, the top cap rail 30, as shown in FIG. 3, can be placed on an existing rail 6 of vessel wall 8. At corners of the rim 10, a seam cap 60 may be secured over the rail cap 30. Optionally, referring still to FIG. 3, one embodiment of the rim 10 could include a substructure channel 20 received within the rail cap 30. The substructure channel 20 is placed on an existing railing 6 of a vessel wall 8, the rail cap 30 is then placed over the substructure channel 30 and, at corners of the rim 10, the seam caps 60 may secured over the rail cap 30.

Referring 6-8, according to the embodiment of FIG. 3, the substructure channel 20 includes a substructure surface 22 and two spaced apart substructure walls 24, 26 depending from the substructure surface 22. The substructure walls 24, 26 define a substructure cavity 25 having an open end 23. The substructure cavity 25 is adapted to receive the open end 2 vessel wall 8 of an existing liquid-containing vessel 1, which may include railing 6, which is explained below. The rail cap 30 includes a cap surface 32 and two spaced apart rail cap walls 34, 36, which depend from the cap surface 32. Cap surface 32 could be planar, but any shape desired for both aesthetic and functional purposes is contemplated by the present invention. The rail cap walls 34, 36 define a rail cap cavity 35 having an open end 33, as best shown in FIG. 10. As shown, in FIGS. 6-10, the rail cap cavity 35 could optional receive and engage the substructure channel 20. Alternatively, as explained in more detail below, the rail cap cavity 35 could be adapted to engage the vessel wall 8 via railing 6 directly. The substructure channel 20 also includes a plurality of spacers 21 for supporting and preventing collapse of cap surface 32 of rail cap 30. Both the substructure channel 20 and/or the rail cap 30 could be manufactured by extruded material, such as polyvinyl chloride (PVC). The substructure channel 20 may even be constructed of metal. In one embodiment, the rail cap 30 is constructed of capped fibrex material.

Figure 6:
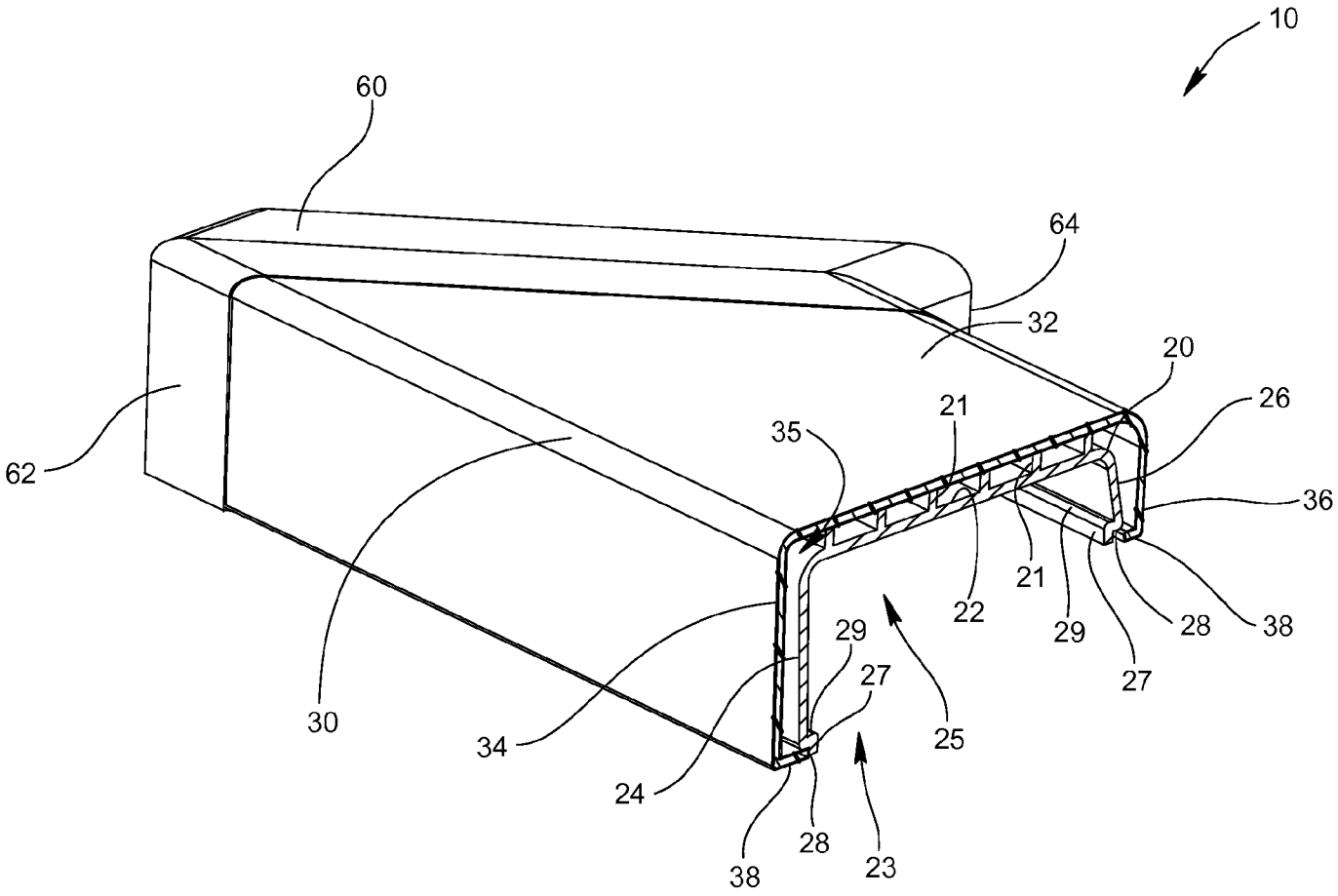
FIG. 6 is a partial perspective sectional view of the rim of the liquid-containing vessel of FIG. 4 according to the present invention taken at line VI-VI of FIG. 5.
Figure 7:
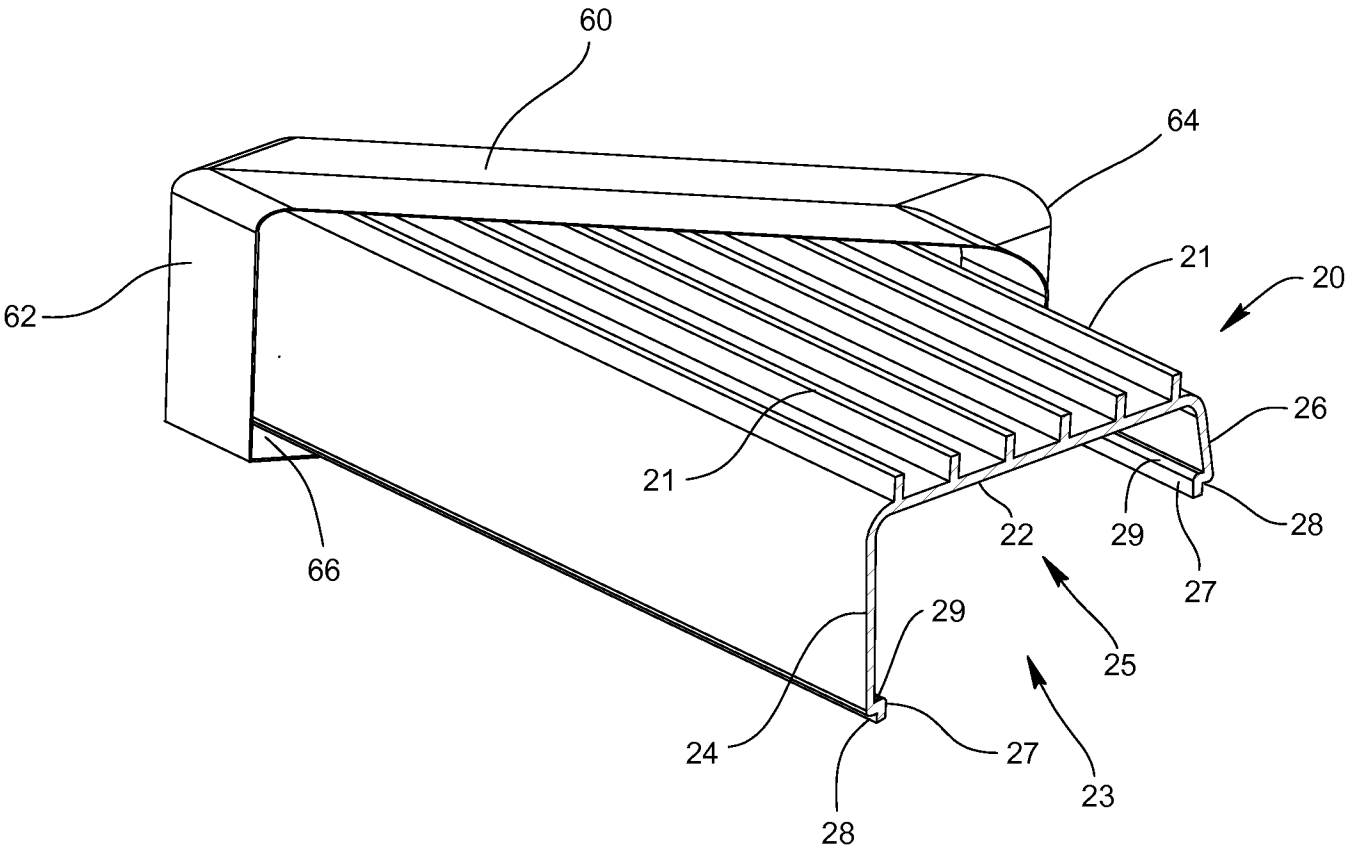
FIG. 7 is the view of FIG. 5 without a rail cap.
Figure 8:
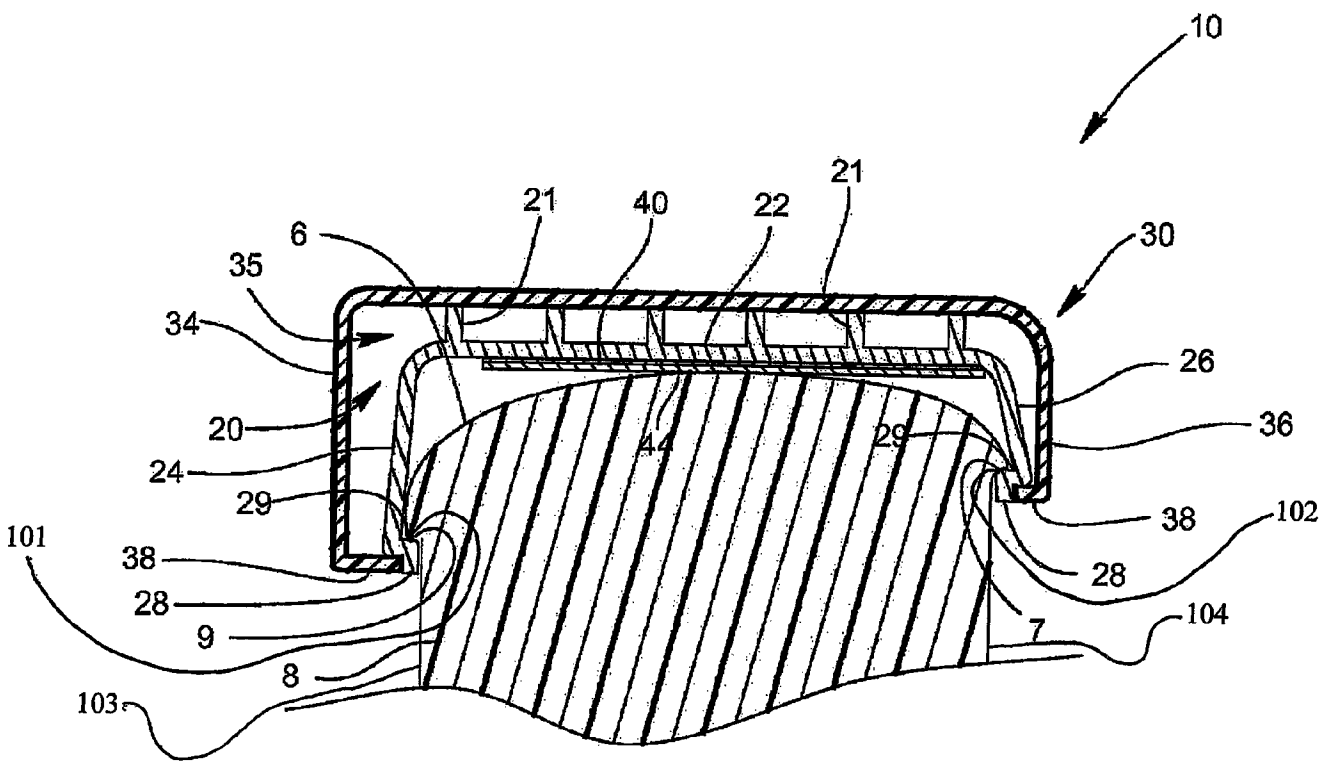
FIG. 8 is a side elevation view of the rim engaged with the liquid containing vessel of FIG. 4 taken on line VI-VI at FIG. 5.

Again, referring to FIGS. 6-8, the substructure channel 20 and the rail cap 30 could be fixedly attached to each other. One way of accomplishing this is by providing rail cap rail walls 34, 36 with at least one vessel engagement protuberance 38 positioned at the open end 33 of rail cap cavity 35. As shown, each of walls 43, 36 includes a protuberance 38, but a protuberance could be positioned on one of walls 34, 36. The protuberances 38 depend from walls 34, 36 and extend inward toward rail cap cavity 35. The substructure channel 20 may include a protuberance receiving recess 28 defined on walls 24, 26 of substructure channel 20. The protuberance receiving recesses 28 may be defined on an internal extension 27 of walls 24, 26. The internal extensions 27 extend inward toward substructure cavity 25 and are positioned at the open end 23 of substructure cavity 35. The internal extensions 27 define internal edges 29 for engaging a vessel wall 110, which is explained in more detail below. As shown in FIGS. 6-8, the rail cap 30 can fit over the substructure channel 20, such that the protuberances 38 can fit into recesses 28 of walls 24, 26, thereby providing an interference fit between substructure channel 20 and rail cap 30. In this manner, the substructure channel 20 is secured in the cavity 35 of rail cap 30.

Figure 9:
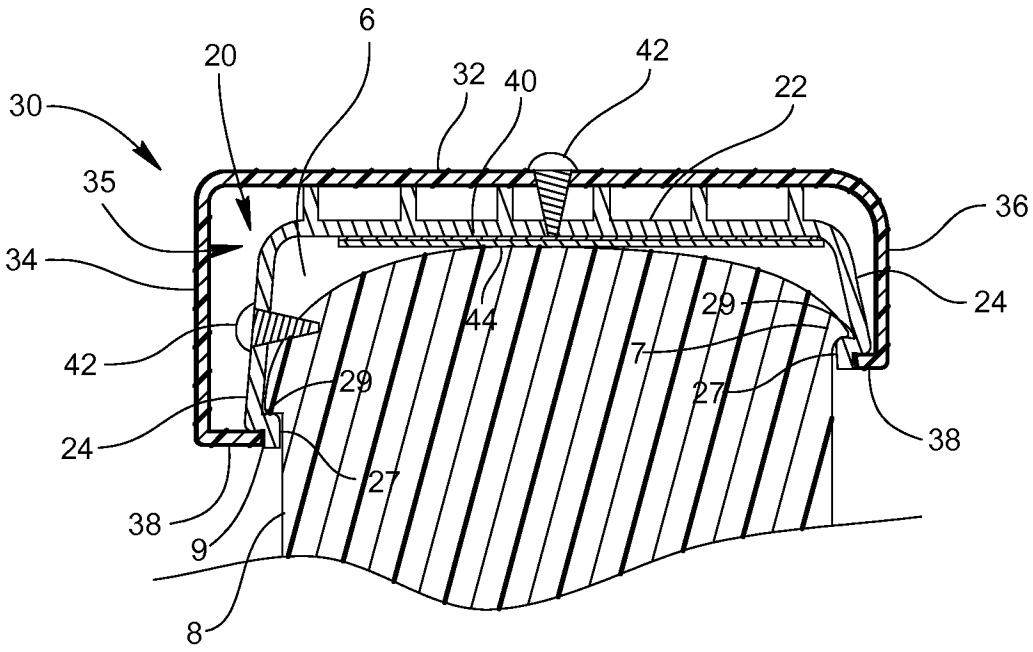
FIG. 9 is the view of FIG. 8 including mechanical fasteners.
Figure 10:
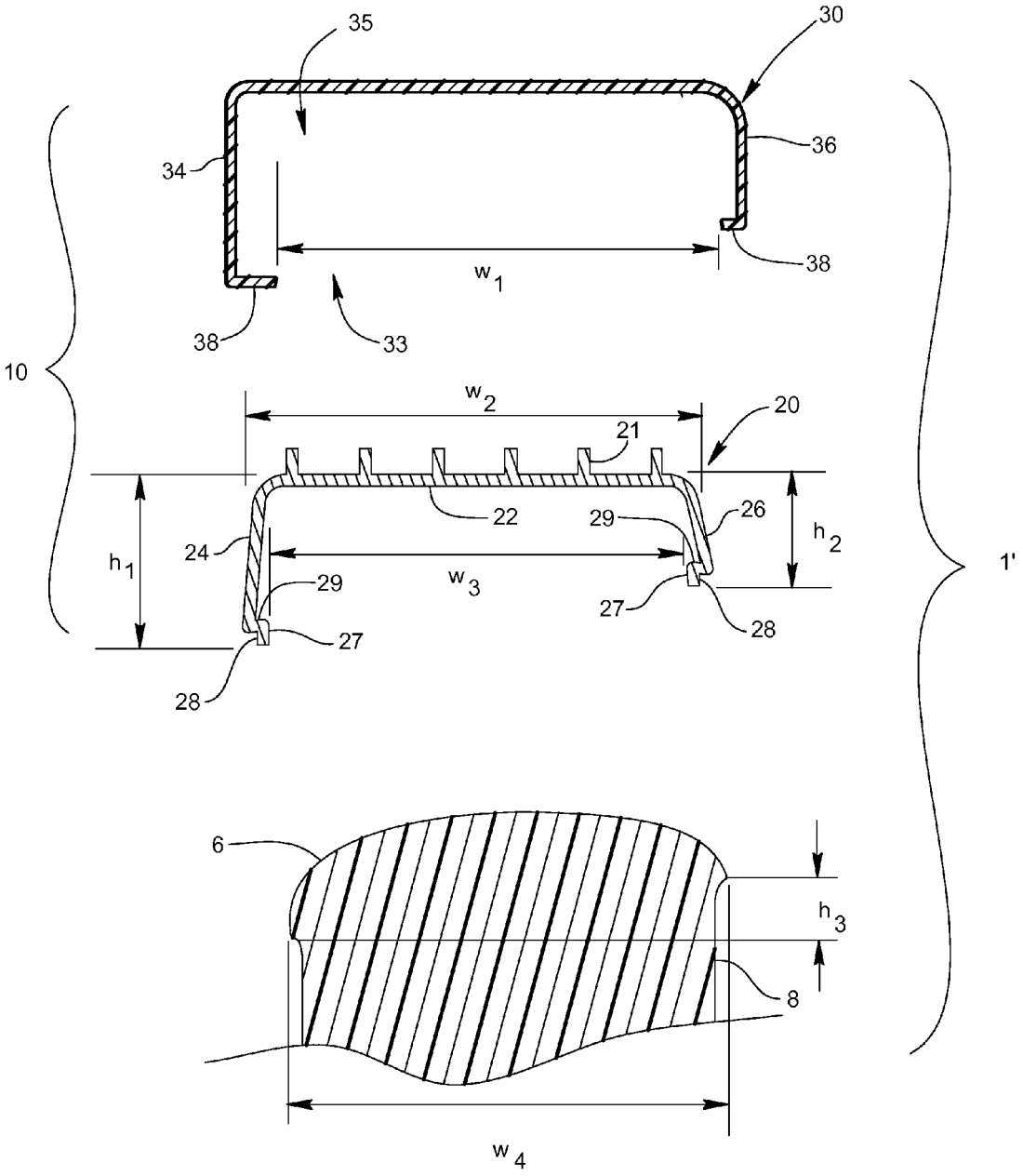
FIG. 10 is an exploded view of the view of FIG. 8 without a gasket or adhesive layer.

Referring now to FIGS. 8-10, the vessel railing 6 of vessel wall 8 could optionally include an internal protrusion 7 and an external protrusion 9. The underside of external protrusion 9 defines a first undercut ledge 101 on an exterior surface 103 of vessel wall 8. The underside of internal protrusion 7 defines a second undercut ledge 102 on an interior surface of vessel wall 8. As shown, the internal edges 29 of the substructure walls 24, 26 could abut the underside of external protrusion 9 and internal protrusion 7, respectively, to engage the substructure channel 20 with vessel wall railing 6 in an interference fit arrangement. In this manner, the open end 2 of vessel wall 8 is received within the substructure cavity 25, and substructure channel 20 is thereby secured to the vessel wall 8.

As best shown in FIG. 10, one of the substructure channel walls 24, 26 may be longer than the other, wall 24 having a length $h_1$ and wall 26 having a length $h_2$. This may be due to the particular way that the vessel wall 8 or railing 6 is shaped or any particular design considerations. Again referring to FIG. 10, the internal protrusion 7 and external protrusion 9 are offset having a difference in height $h_3$. Substructure wall 26 could, therefore, be shorter than substructure wall 24 in order to compensate for this offset. Likewise, the rail cap wall 36 could be shorter than rail cap wall 34 in order to account for the offset in length of substructure walls 24, 26.

Referring back to FIG. 8, the rim 10 could also include an adhesive layer 40 and gasket 44 positioned underneath the substructure channel surface 22 in the rail cap cavity 35. The adhesive layer 40 could be an adhesive strip, such as a double sided adhesive tape, positioned along the cap surface 32 in the rail cap cavity 35 or along the substructure surface 22 in substructure cavity 25. The gasket 44 provides a seal between the substructure channel 20 and the railing 6. Therefore, the rim 10 is protected against leakage of liquid under substructure channel 20 from the liquid-containment area 5 of vessel 1. The adhesive layer 40 could be positioned on the underside of substructure channel surface 22, as shown. However, the adhesive layer 40 could also be positioned on an underside of the gasket 44 to directly contact the vessel wall 8 or railing 6. Alternatively, gasket 44 may be absent from rim 10, wherein an adhesive layer 40 contacts the underside of substructure channel surface 22 to directly adhere the substructure channel surface 22 or cap surface 32 of rail cap 30, as shown in FIGS. 15-18, to the railing 6.

As shown in FIG. 9, in an alternative embodiment, the rim 10 may include mechanical fasteners 42 for fastening the substructure channel 20 to the vessel wall 8 and the rail cap 30 to the substructure channel 20. As shown, the mechanical fasteners 42 could extend through the rail cap surface 32 into the substructure channel surface 22. Also, one of the mechanical fasteners 42 could optionally extend through substructure channel surface 22 into railing 6, thereby securing the rim 10 to vessel wall 8.

The construction of the rim 10 will now be explained in connection with the exploded view of FIG. 10. As shown, the substructure channel 20 could be wider than the distance $w_1$ between protuberances 38 of rail cap 30, the substructure surface 22 having a width $w_2$. This allows the protuberances 38 to be positioned under the walls 24, 26 of substructure channel 20 to be received within protuberance receiving recesses 28. In this manner, the interference fit between substructure channel 20 and rail cap 30 is provided.

Still referring to FIG. 10, the internal edges 29 of substructure walls 24, 26 could be spaced a distance $w_3$ and the vessel wall railing 6 could have a width $w_4$ that is actually wider than the distance $w_3$ between the internal edges 29. Like the rail cap 30 being positioned over the substructure channel 20, this allows the internal edges 29 to abut the underside of the protrusions 7, 9 to provide an interference fit between the substructure channel 20 and the railing 6.

Referring back to FIGS. 2 and 5, a fully constructed rim 10 is shown positioned on and attached to a liquid-containing vessel 1' according to the present invention. The completed rim 10 includes a plurality of separate rim segments 50. Each segment 50 includes both a substructure channel 20 and a rail cap 30, as defined above, with the rail cap 30, as shown, optionally defining an external surface of the rim 10. However, as explained in more detail below, in one embodiment, shown in FIG. 3, each segment 50 could include a rail cap 30 only engaged directly to the railing 6 of vessel wall 8. In this manner, each rail cap 30 and, optionally, substructure channel 20 will be equal in length to the desired length of each segment 50. Each segment 50 could also optionally include a gasket 44 and/or an adhesive layer 40.

As shown best in FIGS. 2 and 5, the rim segments 50 are positioned such that they are oriented adjacent to one another to define a closed perimeter rectangular vessel rim 10. For example, the rim 10 illustrated in FIGS. 2 and 5 includes four rim segments 50 positioned at right angles to one another to form a closed rectangular liquid-containing vessel 1'. One way of accomplishing the illustrated configuration is by providing both ends 52 of each rim segment 50 with a 45 degree mitered cut, such that the segments 50 could be of equal length and positioned at 90 degrees to one another to form a square closed perimeter vessel rim 10.

As shown in FIGS. 3 and 4, adjacent segments 50 could have a seam 55 defined therebetween. Therefore, directly adjacent segments 50 must be secured to each other in some manner.

Figure 11:
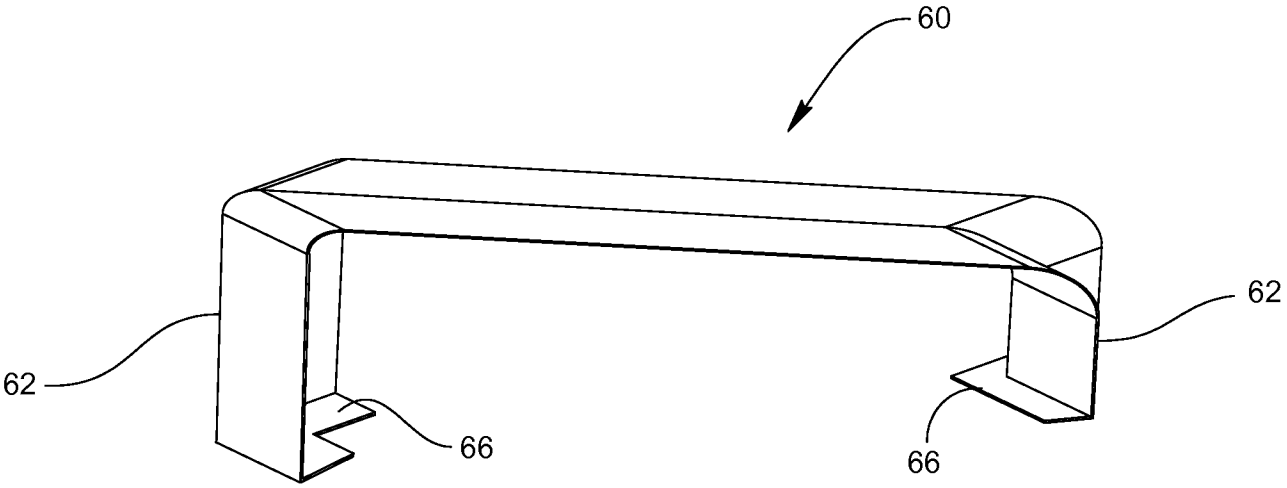
FIG. 11 is a perspective view of a seam cap of the rim of FIG. 2.
Figure 12:
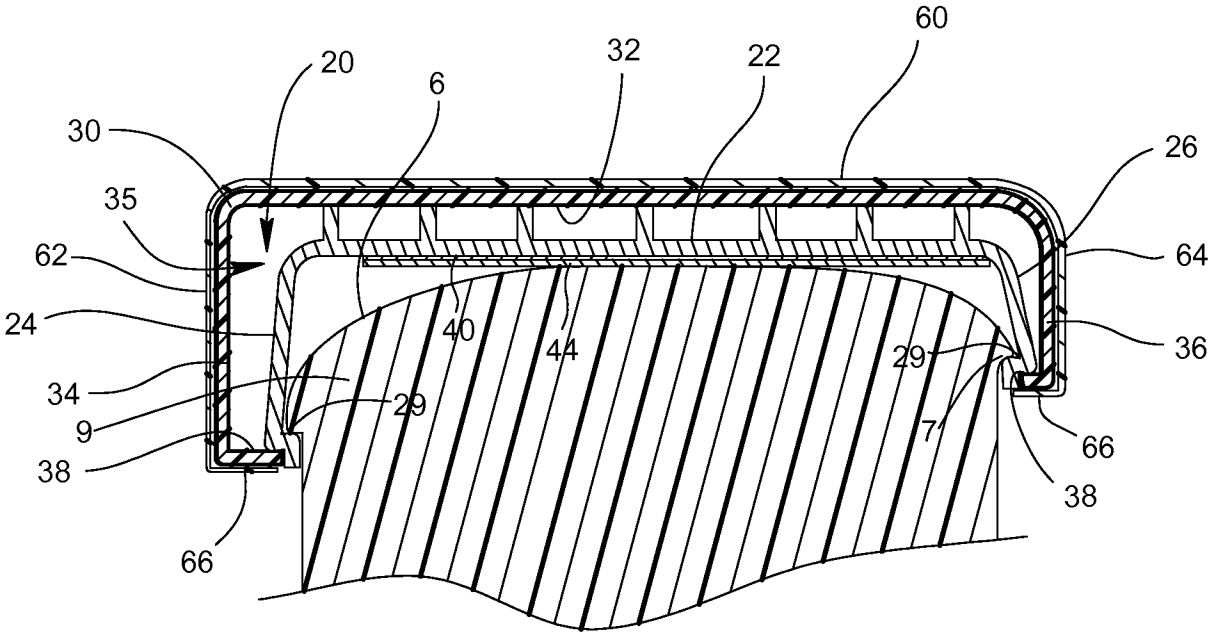
FIG. 12 is a side elevation view of the rim of the liquid-containing vessel of FIG. 4 taken at line XII-XII of FIG. 5.
Figure 13:
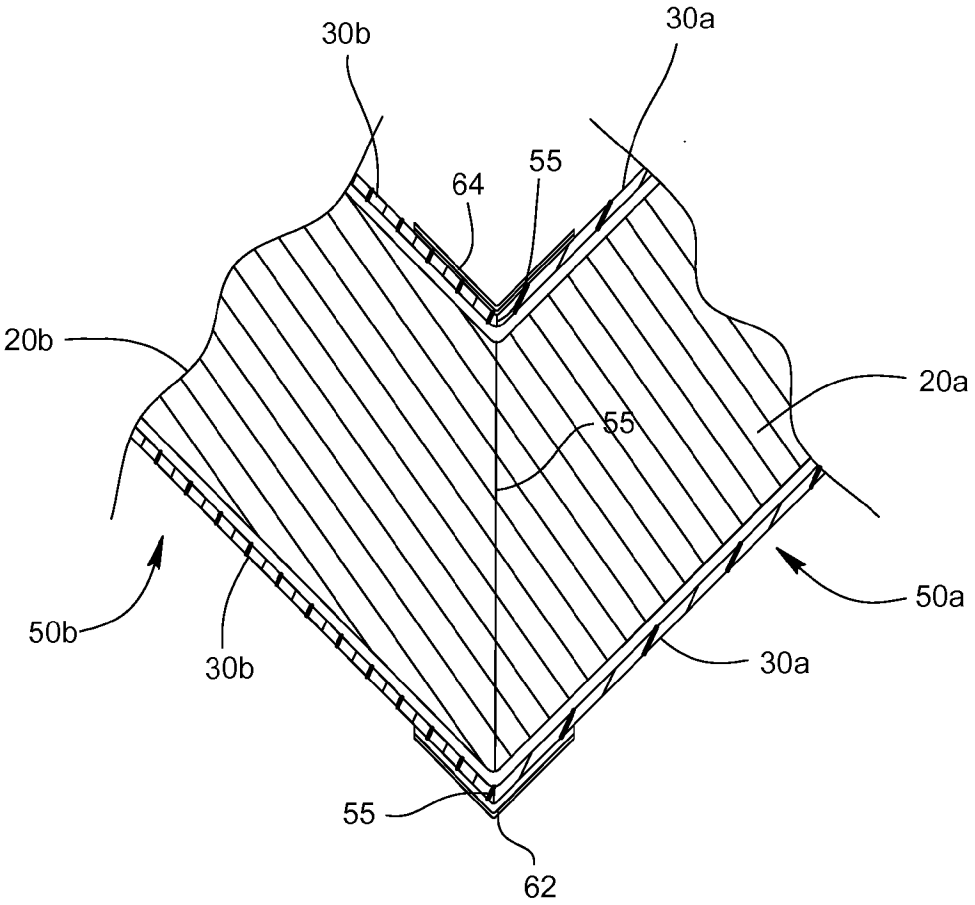
FIG. 13 is a sectional view of the rim of the liquid-containing vessel FIG. 4 taken at line XIII-XIII of FIG. 2.

One way of securing directly adjacent segments 50 is by providing a seam cap 60, as shown in FIGS. 2-5, 11-13, and 17-18. Seam cap 60 is also shown in the partial perspective views FIGS. 5-6. Referring specifically to FIG. 11, the seam cap 60 includes two spaced apart engagement members 62, 64 depending therefrom. The engagement members 62, 64 each include an engagement surface 66, which extends toward the inside of the seam cap 60. Also, as shown in FIGS. 11 and 13, the engagement member 62 is shaped to accommodate the external edge of a square corner, such as that at the seam 55 between ends 52 of segments 50. Likewise, engagement member 64 is shaped to accommodate the internal edge of a square corner. However, the engagement members 62, 64 could be of any shape reasonably necessary to engage and secure two adjacent rim segments 50 positioned in any configuration, for example, a round corner or a seam between two in-line segments 50. The cross-section of FIG. 12 shows the engagement of seam cap 60 over a rim segment 50 at seam 55 between ends 52. As shown, the substructure channel 20 and the rail cap 30 are positioned in the same manner as described above, with respect to FIGS. 8-10. The seam cap 60 is then positioned over the rail caps 30 of two adjacent segments 50 at seam 55 formed therebetween to engage the adjacent segments 50 to fix them in position. The seam cap 60 can be placed in position to engage the rail caps 30 in substantially the same manner the substructure channel 20 and rail cap 30 engage each other and the vessel wall 110, for example, in an interference fit. The engagement surfaces 66 are positioned under the protuberances 38 of rail cap 30, thereby engaging the rail cap 30 fixing adjacent segments 50 in position.

FIG. 13, which is a top cross-sectional view of the ends 52 of two adjacent rim segments 50*a*, 50*b* taken at line XIII-XIII of FIG. 2, more clearly illustrates the engagement of seam cap 60 with any two adjacent segments 50. As illustrated, the engagement members 62, 64, and, therefore, the engagement surfaces 66 extend across the seam 55 and the rail caps 30*a*, 30*b* and substructure channels 20*a*, 20*b*. The rim segments 50*a*, 50*b*, including the protuberances 38 of the rail caps 30*a*, 30*b*, are, thereby, engaged and secured together by the seam cap 60. Like the substructure channel 20 and the rail cap 30, the seam cap 60 could be constructed of an extruded material, such as PVC, or, alternatively, could be constructed of capped fibrex.

Figure 14:
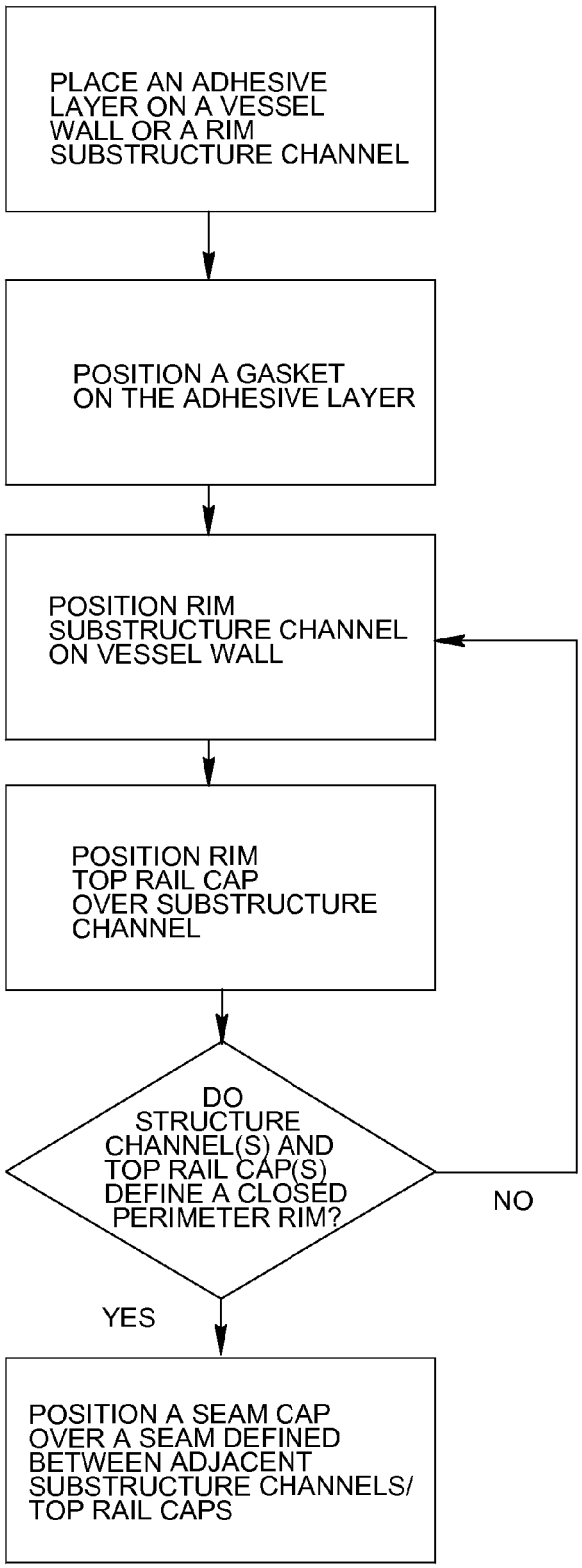
FIG. 14 is a process flow diagram of an embodiment of constructing a rim according to the present invention.

One embodiment of constructing a rim 10, according the present invention, is summarized in the process flow diagram of FIG. 14. The method of constructing could include retrofitting an existing liquid-containment vessel 1 with a rim 10, or constructing a new liquid-containment vessel 1', such as a spa, bath tub, or pool, with the rim 10. The method could include placing an adhesive layer 40 on a vessel wall 8 or railing 6 of wall 8. However, as noted above and shown in FIGS. 8-9, the adhesive layer 40 could be placed on the bottom of a substructure channel surface 22. A gasket 44 could then be placed over the vessel wall 8 or railing 6, which may include the adhesive layer 40. The substructure channel 20 could then be positioned over the vessel wall 8, as explained above, such that the vessel wall 8 or railing 6 is received within substructure cavity 25. At this point, the rail cap 30 could be placed over the substructure channel 20, such that the substructure channel 20 is positioned in the cavity 35, as explained above. These steps may then be repeated until a closed perimeter rim 10 is defined by the substructure channel 20 and rail cap 30, such as by positioning separate rim segments 50 adjacent to each other, like those of FIGS. 2 and 5. Finally, if a seam 55, illustrated in FIG. 13, is formed between adjacent substructure channels 20 and rail caps 30, such as between adjacent rim segments 50, a seam cap 60 could be positioned over the seam 50 to secure adjacent substructure channels 20 and rail caps 30.

Figure 15:
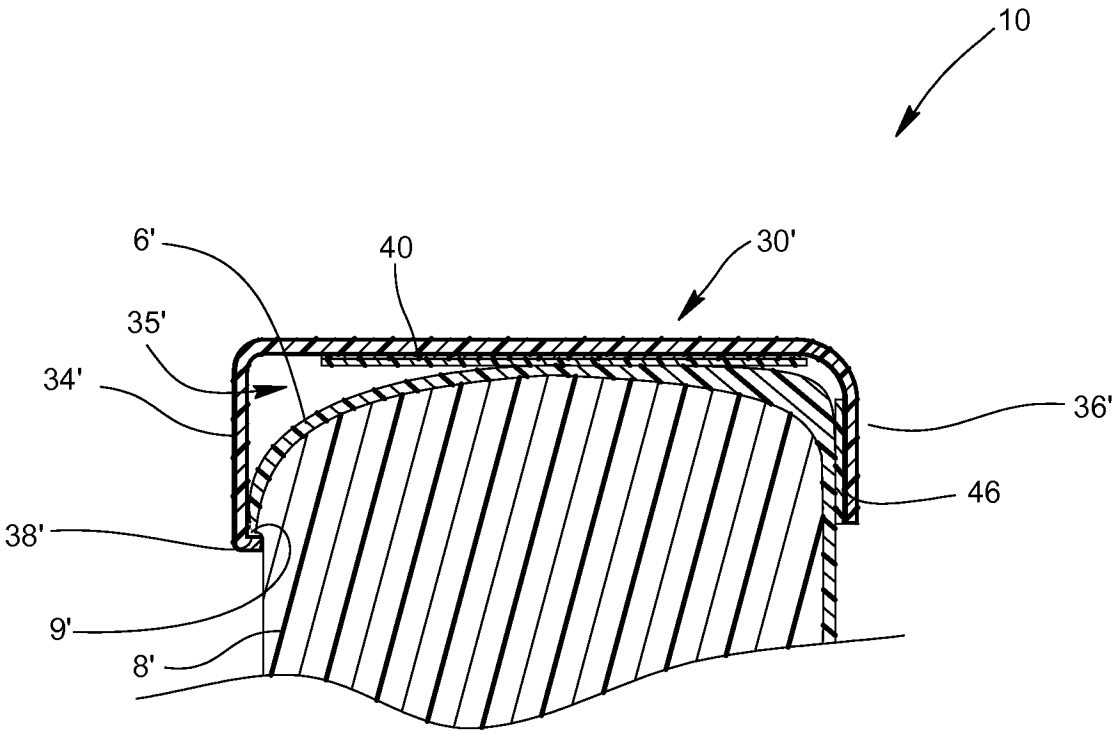
FIG. 15 is a sectional view of the rim of the liquid-containing vessel of FIG. 4 according to the present invention taken at line VI-VI of FIG. 5.

FIG. 15 shows a cross-section of an embodiment of a rim 10' taken on line VI-VI of FIG. 5 without a substructure channel, such as shown in FIG. 3. As shown, the rail cap 30' has a cap surface 32' and two spaced apart rail cap walls 34', 36' attached to and depending from cap surface 32'. The rail cap 30' is adapted to engage the vessel wall 8' directly via rail 6'. As shown, the railing 6' of the open end 2' of the wall 8' is received within the rail cap cavity 35'. Like the above-described embodiments of FIGS. 3 and 6-13, the rail cap 30' can include at least one vessel engagement protuberance 38' positioned at the open end 33' of rail cap cavity 35' on one of walls 34', 36' extending inward toward the rail cap cavity 35' adapted to engage the vessel wall 8'. As illustrated, a vessel engagement protuberance 38' is shown on wall 34' extending inward toward rail cap cavity 35'. Like the above described embodiments, the rim 10' of FIG. 15 may also include an adhesive layer 40 positioned on the cap surface 32' in the rail cap cavity 35'. The rail cap 30' may include a planar surface, such as cap surface 32'. As shown, the adhesive layer 40 is positioned directly between the rail cap 30' and the vessel wall railing 6' in rail cap cavity 35'.

Figure 16:
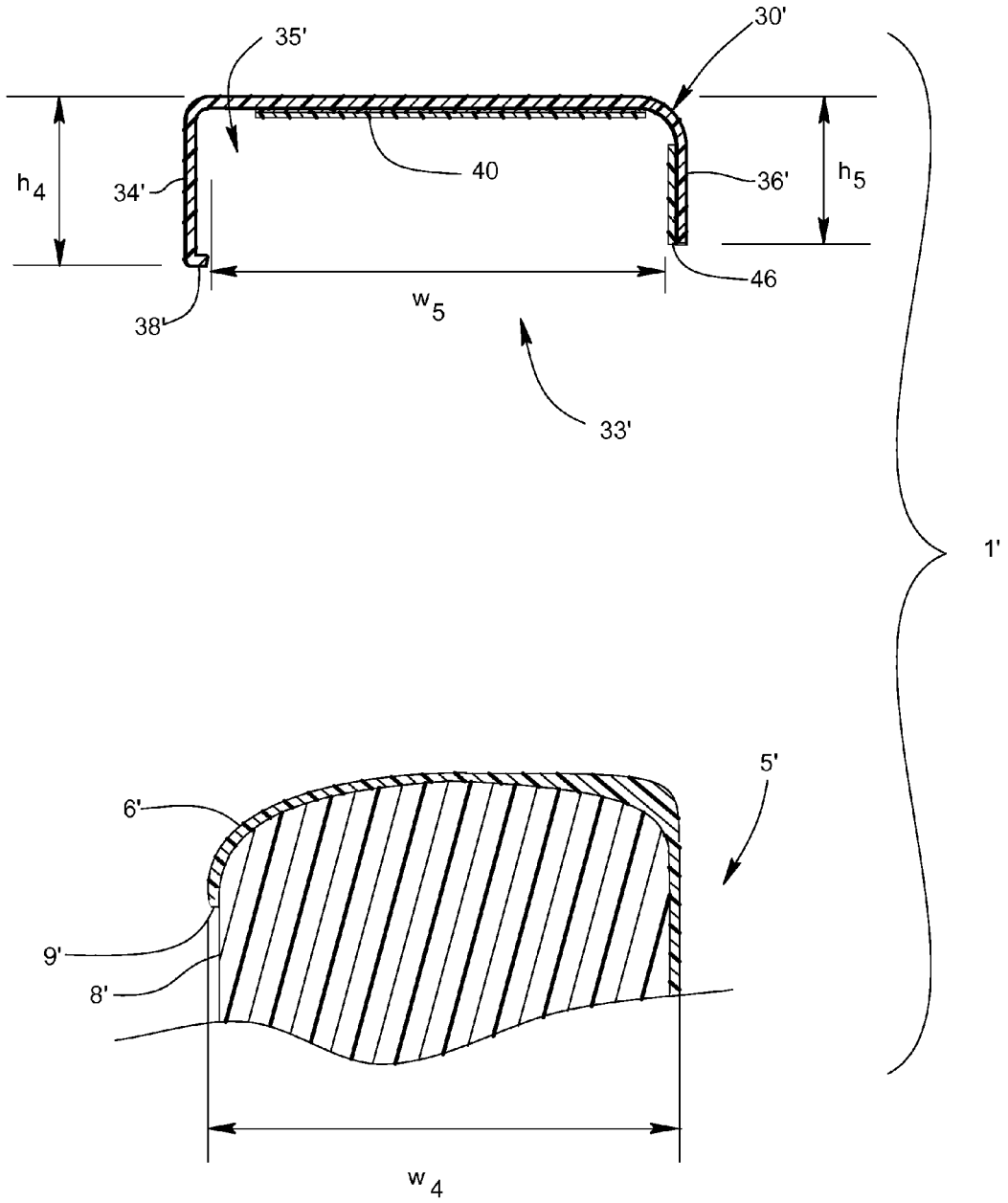
FIG. 16 is an exploded view of FIG. 15.

Referring to FIGS. 15-16, as shown, the vessel rail 6' may take the form of a continuous shell having a rail edge 9' and extending into liquid-containment area 5'. The rail 6' could be part of an acrylic shell of a spa, for example. In this manner, the internal side, i.e., liquid-containment area 5' does not include a protrusion, such as 7, 9 of FIGS. 8-10. As illustrated, the vessel rail 6' may be a flat wall on the liquid-containment area side. The railing 6' is positioned over wall 8', with the rail edge 9' providing an external edge that can be engaged by rail cap 30'. As shown, the single vessel engagement protuberance 38' of the rail cap wall 34' abuts the underside of rail edge 9', thereby engaging the vessel wall railing 6' in an interference fit arrangement. In this manner, the open end 2' of vessel wall 8' is received within the rail cap cavity 35', securing the rail cap 30' to the vessel wall 8'. Because railing 6' includes a smooth surface on the liquid-containment area side, the rail cap wall 36' can be a flat downwardly extending wall depending from cap surface 32'. Wall 36' may include a moisture barrier 46 positioned on an inside surface thereof in rail cap cavity 35'. The moisture barrier 46 may take the form of a sponge-like material strip having an adhesive strip on one side.

As explained above, with respect to FIG. 10, the rail cap wall 36 could be shorter than rail cap wall 34 in order to account for the offset in length of substructure walls 24, 26. Referring now to FIG. 16, likewise, the rail cap walls 34', 36' could be of differing heights $h_4$, $h_5$. For example, one of walls 34', 36' could be longer than the other. Also, as shown, the rail cap 30' could include a distance $w_5$ between protuberance 38' and wall 36' that is adjusted to account for the width $w_4$ of railing 6'. The distance $w_5$ accounts for the lack of the substructure channel 20, shown in the previous embodiment illustrated in FIG. 10. For example, $w_5$ may be shorter than $w_2$ of FIG. 10.

Figure 17:
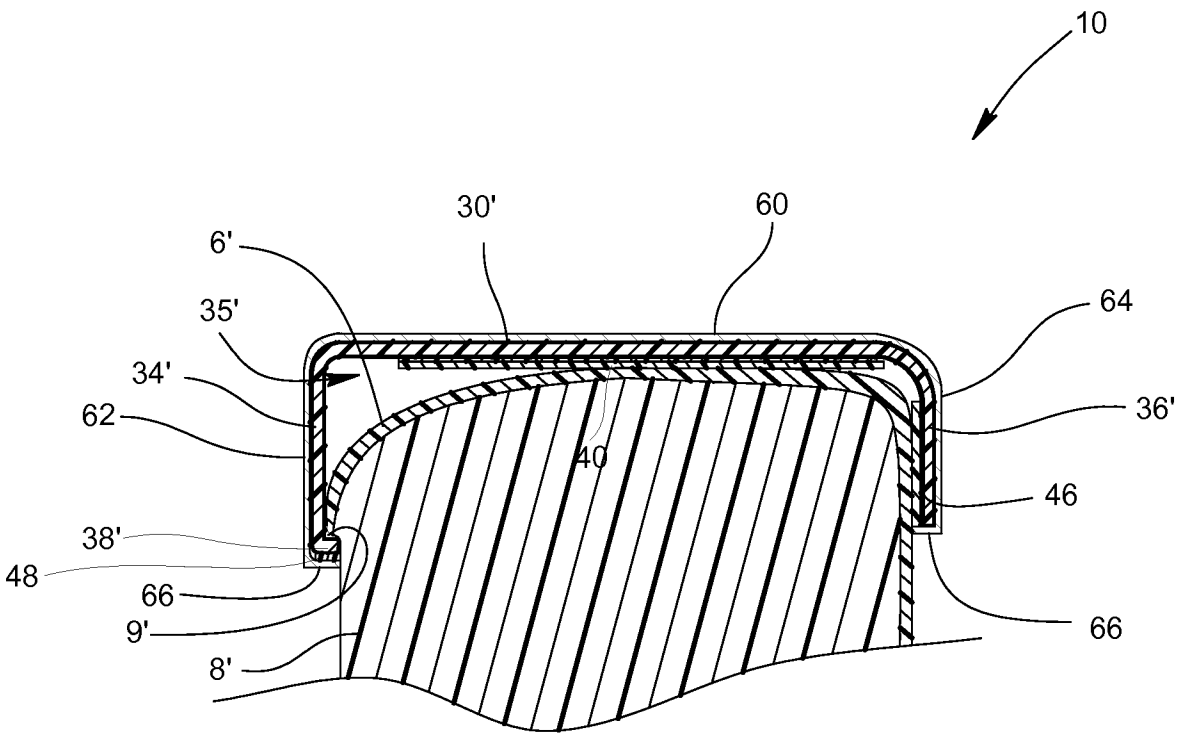
FIG. 17 is a sectional view of the rim of the liquid-containing vessel of FIG. 4 taken at line XII-XII of FIG. 5.
Figure 18:
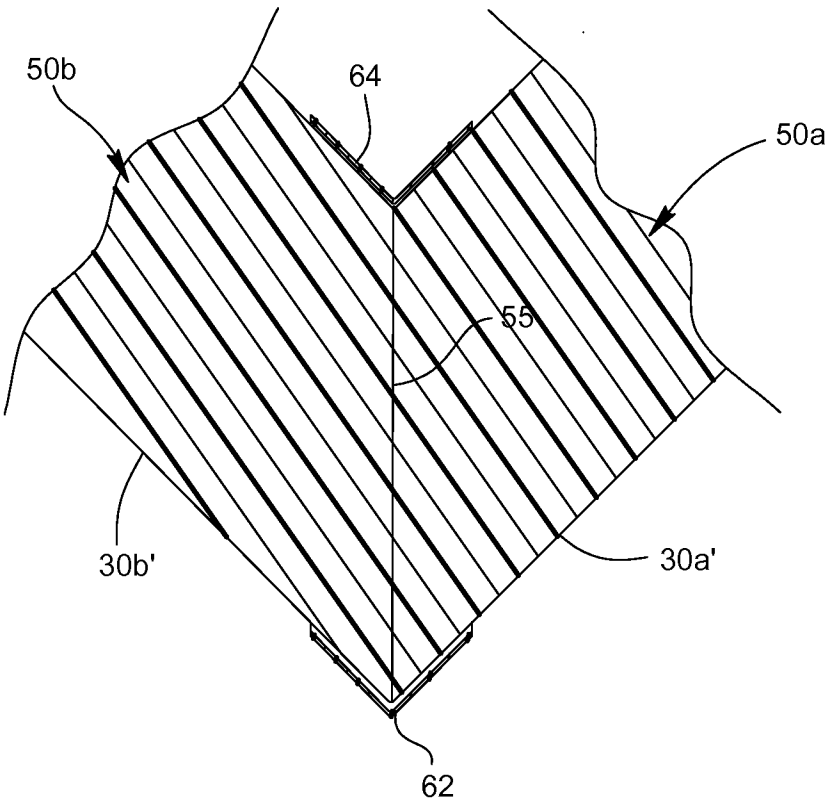
FIG. 18 is a sectional view of the rim of the liquid-containing vessel of FIG. 4 taken at line XIII-XIII of FIG. 2.

Referring now to FIG. 2 and FIGS. 17-18, a seam cap 60, as described above, may be positioned over two adjacent segments of the plurality of rim segments 50. In this embodiment, each rim segment 50 will include a rail cap 30', and, optionally, an adhesive layer 40. As shown in FIG. 18, the seam cap 60 is positioned and extends over two adjacent rim segments 50*a*, 50*b* having a seam 55 formed therebetween. Referring back to FIG. 17, the engagement members 62, 64 engage the adjacent segments 50*a*, 50*b* via engagement surface 66 to fix the segments 50*a*, 50*b* in position. As shown in FIG. 17, the engagement surfaces 66 abut the underside of protuberance 38' and wall 36' at open end 33' of rail cap cavity 35' of adjacent rail caps 30'. The engagement surface 66 on wall 62 of seam cap 60 may include an adhesive layer 48 to secure the engagement surface 66 with protuberance 38'. With the exception of the adhesive layer 48 and the absence of substructure channel 20 and a protuberance 38' on wall 36', the seam cap 60 engages the rail cap 30' of each segment 50 in the same manner as described above with respect to FIGS. 11-13.

Figure 19:
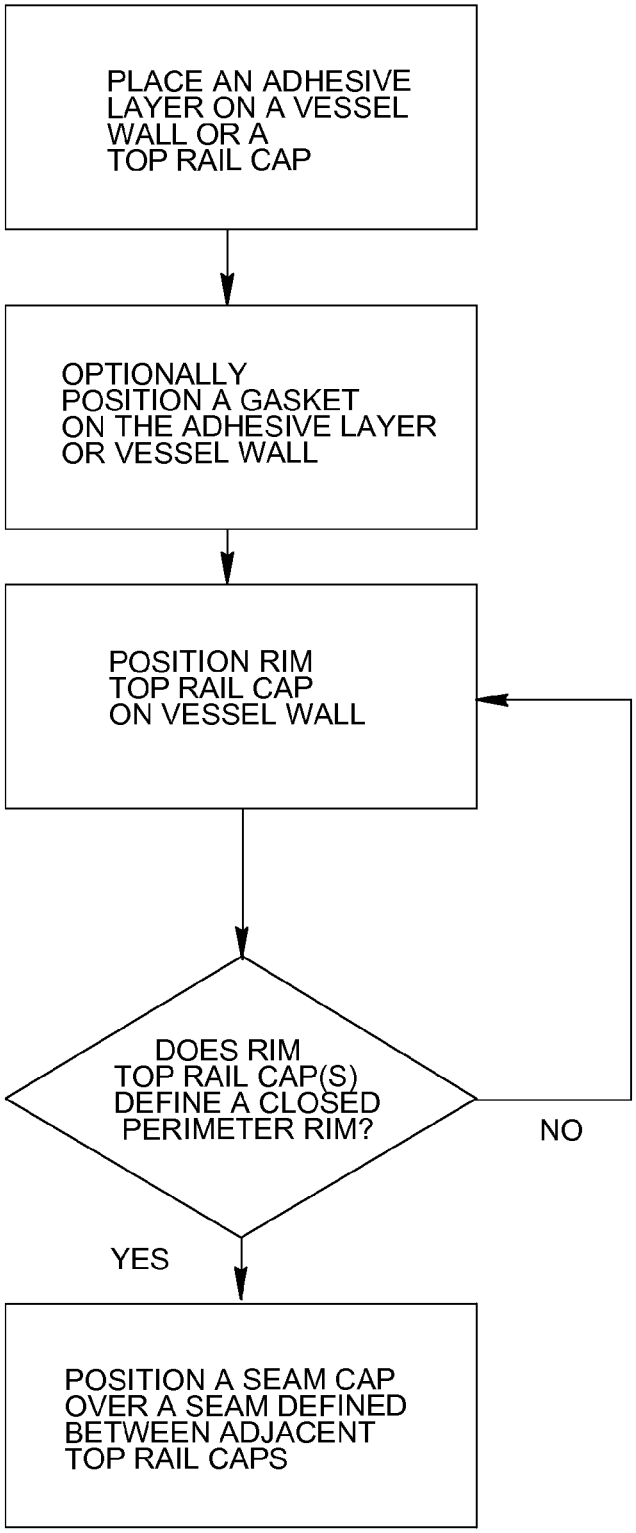
FIG. 19 is a process flow diagram of another embodiment of constructing a rim according to the present invention.

Another embodiment of constructing a rim 10', according to the present invention, is summarized in the process flow diagram of FIG. 19. Like the above-described method, this method of constructing could include retrofitting an existing liquid-containment vessel 1 with a rim 10', or constructing a new liquid-containment vessel 1', such as a spa, bath tub, or pool with the rim 10'. The method could include placing an adhesive layer 40 on a vessel wall 8' or railing 6' of wall 8' or rail cap 30', such as on cap surface 32' in rail cap cavity 35'. A gasket 44 could then be placed between the vessel wall 8' or railing 6' and the rail cap 30', for example, on the adhesive layer 40. The rail cap 30' could then be positioned over the vessel wall 8', as explained above, such that the vessel wall 8' or railing 6' is received within rail cap cavity 35'. These steps may then be repeated until a closed perimeter rim 10' is defined by the rail cap 30', such as by positioning separate rim segments 50 adjacent to each other, like those of FIGS. 2 and 5. Finally, if a seam 55 is formed between adjacent rail caps 30', such as shown in FIG. 18, a seam cap 60 could be positioned over the seam 55 to secure adjacent segments 50 of rail caps 30'.

The above-described methods and rim provides a uniform rim surface about the perimeter of the liquid-containing vessel 1', as shown in FIGS. 2-5. The uniform rim provides both functional and aesthetic advantages.

While specific embodiments of the invention have been described in detail, it will be appreciated by those skilled in the art that various modifications and alternatives to those details could be developed in light of the overall teachings of the disclosure. The presently preferred embodiments described herein are meant to be illustrative only and not limiting as to the scope of the invention, which is to be given the full breadth of the appended claims and any and all equivalents thereof.

The invention claimed is:

1. A rim for engaging a vessel wall of an existing liquid-containing vessel, wherein the vessel wall defines a liquid-containment area, and wherein the vessel is open ended, the rim comprising:

a rail cap comprising a cap surface and two spaced apart rail cap walls attached to and depending from the cap surface defining a rail cap cavity adapted to engage an existing exterior railing of the vessel wall of the existing liquid-containing vessel, wherein the rail cap is affixed over and covers the existing exterior railing of the existing vessel wall, and wherein both of said rail cap walls are entirely external to the vessel wall;

a substructure channel having a substructure surface and two spaced apart substructure walls attached to and depending from the substructure surface, wherein the substructure walls define a substructure cavity, and wherein the substructure channel is received within the rail cap cavity;

wherein each of the rail cap walls includes a vessel engagement protuberance and each of the substructure channel walls includes a protuberance receiving recess, each of the vessel engagement protuberances being received within the protuberance receiving recesses to engage the substructure channel in an interference fit arrangement.

2. The rim of claim 1, wherein the cavity of the rail cap includes an open end, and wherein the vessel engagement protuberance is positioned at the open end of the rail cap cavity.

3. The rim of claim 1, further comprising an adhesive layer positioned on the cap surface in the rail cap cavity.

4. The rim of claim 1, wherein the rail cap includes a planar surface.

5. The rim of claim 1, wherein the rail cap comprises a plurality of rim segments, the segments being oriented such that the rim segments are adjacent to each other to define a closed perimeter vessel rim.

6. The rim of claim 5, further comprising a segment seam cap having two spaced apart engagement members depending therefrom, wherein the seam cap is positioned over two adjacent segments having a seam formed therebetween, wherein the engagement members engage the adjacent segments to fix the segments in position.

7. The rim of claim 1, wherein the rail cap is fixedly attached to the substructure channel.

8. The rim of claim 1, wherein the substructure surface includes spacers depending therefrom between the substructure channel and the rail cap.

9. The rim of claim 1, further comprising mechanical fasteners extending through the substructure channel for fastening the substructure to a top surface of the railing of the vessel wall.

10. The rim of claim 1, wherein the substructure cavity of the substructure channel includes an opened end, and wherein each of the substructure channel walls includes an internal edge positioned at the open end of the substructure channel.

11. The rim of claim 4;

wherein each of the vessel engagement protuberances are received within the protuberance receiving recesses, such that the rail cap and the substructure channel are engaged in an interference fit; and wherein the substructure cavity of the substructure channel includes an opened end, wherein each of the substructure channel walls includes an internal edge positioned at the open end of the substructure channel.

12. A liquid-containing vessel comprising:

a vessel wall having an open end and a closed end defining a liquid-containment area;

a rim positioned on the open end of the vessel wall, wherein the open end of the vessel wall comprises an existing exterior railing, the rim comprising:

a rail cap comprising a cap surface and two spaced apart rail cap walls attached to and depending from the cap surface defining a rail cap cavity, wherein the open end of the wall is received within the rail cap cavity;

wherein the rail cap is affixed over and covers the existing exterior railing of the vessel wall;

wherein both of said rail cap walls are entirely external to the vessel wall; and wherein at least one of the rail cap walls includes a vessel engagement protuberance extending inward toward the rail cap cavity and the vessel engagement protuberance engages the railing.

13. The vessel of claim 12, wherein the rail cap and the vessel wall are engaged in an interference fit.

14. The vessel of claim 12, wherein the rim comprises a plurality of adjacent rim segments defining a closed-perimeter rim.

15. The vessel of claim 14, further comprising a segment seam cap having two spaced apart engagement members depending therefrom, wherein the seam cap is positioned over two adjacent rim segments having a seam formed therebetween, wherein the engagement members engage the adjacent segments to fix the segments in position.

16. The vessel of claim 12, wherein:

the railing of the vessel wall further comprises an external protrusion defining a first undercut ledge on an exterior surface of the vessel wall, and an internal protrusion defining a second undercut ledge on an interior surface of the vessel wall;

wherein each rail cap wall includes a vessel engagement protuberance;

wherein each vessel engagement protuberance extends inward toward the rail cap cavity;

wherein a first vessel engagement protuberance coacts with the first undercut ledge on the exterior surface of the vessel wall, and a second engagement protuberance coacts with second undercut ledge on the interior surface of the vessel wall.

17. A method of retrofitting an existing liquid-containment vessel with a rim, wherein the vessel comprises a vessel wall having an open end and closed end defining a liquid-containment area, wherein the open end of the vessel wall comprises an existing exterior railing, wherein the railing of the vessel wall further comprises an external protrusion defining an undercut ledge on an exterior surface of the vessel wall, the method comprising the steps of:

positioning a rail cap having a cap surface and two side walls attached to and depending from the cap surface defining a rail cap cavity on the railing of the open end of the vessel wall, and a vessel engagement protuberance on at least one of the side walls, such that the existing exterior railing is received within the rail cap cavity, the rail cap is affixed over and covers the existing exterior railing, the vessel engagement protuberance coacts with the undercut ledge, and both of said side walls are entirely external to the vessel wall.

18. The method of claim 17, wherein the step of positioning a rail cap on the open end of the vessel wall comprises positioning a plurality of adjacent rim segments to define a closed perimeter rim, and further comprising the step of positioning a segment seam cap over a seam defined between two adjacent segments of the plurality of segments.

19. The rim of claim 1, further comprising an adhesive layer positioned on the substructure surface in the substructure channel.

20. The rim of claim 1, wherein one wall of the rail cap walls is longer than the other rail cap wall;

wherein one wall of the substructure walls is longer than the other substructure wall; and wherein the protuberance receiving recess of the longer substructure wall engages the vessel engagement protuberance of the longer rail cap wall.

21. The vessel of claim 12, wherein one wall of the rail cap walls is longer than the other rail cap wall.

22. The vessel of claim 12, further comprising an adhesive layer positioned on the cap surface in the rail cap cavity.

23. The vessel of claim 22, further comprising a moisture barrier positioned on one of the rail cap walls in the rail cap cavity.

24. The vessel of claim 14, further comprising an adhesive layer positioned on the cap surface in the rail cap cavity, and a moisture barrier positioned on one of the rail cap walls in the rail cap cavity.

* * * * *

UNITED STATES PATENT AND TRADEMARK OFFICE

CERTIFICATE OF CORRECTION

PATENT NO. : 9,062,472 B2
APPLICATION NO. : 13/104256
DATED : June 23, 2015
INVENTOR(S) : Ian P. A. Scali et al.

It is certified that error appears in the above-identified patent and that said Letters Patent is hereby corrected as shown below:

In the claims

Column 9, Line 61, Claim 11, delete "4;" and insert -- 4, --

Column 10, Line 45, Claim 16, after "with" insert -- the --

Signed and Sealed this
Eighth Day of December, 2015

Michelle K. Lee

Michelle K. Lee
*Director of the United States Patent and Trademark Office*